US005546912A

United States Patent [19]

Yamada et al.

[11] Patent Number: 5,546,912

[45] Date of Patent: Aug. 20, 1996

[54] FUEL SUPPLY DEVICE

[75] Inventors: Masaichi Yamada; Junichi Kaku, both of Iwata, Japan

[73] Assignee: Yamaha Hatsudoki Kabushiki Kaisha, Shizuoka-Ken, Japan

[21] Appl. No.: 355,532

[22] Filed: Dec. 14, 1994

[30] Foreign Application Priority Data

Dec. 14, 1993 [JP] Japan ..... 5-343169

[51] Int. Cl.[6] ..... F02M 37/10; F02M 55/00; F02M 49/00

[52] U.S. Cl. ..... 123/511; 123/179.16

[58] Field of Search ..... 123/446, 447, 123/456, 179.9, 179.12, 179.14, 179.16, 179.17, 510, 511

[56] References Cited

U.S. PATENT DOCUMENTS 2,881,749 4/1959 Pringham ..... 123/179.12
4,284,040 8/1981 Baltz et al. ..... 123/179.11
4,286,553 9/1981 Baltz et al. ..... 123/179.11
4,375,206 3/1983 Baltz et al. ..... 123/179.11
4,462,346 7/1984 Haman et al. ..... 123/179.9
4,498,434 2/1985 Baltz et al. ..... 123/179.11
4,590,904 5/1986 Wannenwetsch ..... 123/179.17
4,807,583 2/1989 Thornthwaite et al. ..... 123/510
5,213,083 5/1993 Glassey ..... 123/179.17
5,421,306 6/1995 Talaski ..... 123/510
5,425,342 6/1995 Ariga et al. ..... 123/456

*Primary Examiner*—Thomas N. Moulis
*Attorney, Agent, or Firm*—Knobbe, Martens, Olson & Bear

[57] ABSTRACT

A fuel supply device for delivering pressurized fuel to the fuel injection valves of an internal combustion engine, wherein a pressurizing device pressurizes a fuel distribution line independently of a high pressure pump, which further raises and maintains the pressure of the fuel distribution line. This independent pressurization by the pressurizing device reduces the time required for the high pressure pump to raise fuel pressure to a level desirable for fuel injection, thus reducing the time it takes to start such an engine.

24 Claims, 3 Drawing Sheets

FUEL SUPPLY DEVICE

BACKGROUND OF THE INVENTION

This invention relates to a device for supplying pressurized fuel to a fuel injected engine, and more particularly to a fuel supply device for more quickly pressurizing fuel sent to the injection valves.

It has been well-known that the fuel efficiency, performance and emission control of an engine can be improved by use of a fuel injection system. With such systems, fuel must be delivered under pressure (about 30 kg/cm$^2$) through fuel injection valves of the fuel injectors, which valves open and close as fuel is sprayed to the engine. Conventionally, the required pressure is supplied by a high pressure fuel pump driven in association with the engine's crankshaft.

However, when an engine using this conventional arrangement has been turned off for an extended period of time, internal leaks in the high pressure pump and possible leakage from open fuel injection valves cause a drop in pressure. Thus, inadequately pressurized fuel reaches the injection valves as the engine begins to turn over, leading to insufficient fuel injection and a slower starting response from the engine. This, in turn, leads to an accordingly slow build-up of pressure in the fuel distribution line, since the high pressure fuel pump is driven by the engine's crankshaft.

There is thus a circular dependence of the pressurization rate upon output from the engine, and output from the engine upon the pressure in the fuel distribution line. As a result, the length of time required to start an engine with conventional means for pressurizing the fuel ultimately depends upon the pressure in the fuel distribution line before the starting process is begun. As the engine remains off longer, the leakage of fuel increases, pressure decreases, and starting the engine will take longer.

The delay in starting the engine is compounded in some fuel supply arrangements wherein a pressure accumulation chamber is employed, which accumulates and absorbs pressure pulses caused by the pumping of the high pressure fuel pump. Including such a pressure accumulation chamber in the fuel supply device increases the volume of fuel to be pressurized. Thus, it takes even longer for the high pressure pump to pressurize the fuel distribution line to the appropriate level.

It is therefore an object of this invention to provide a fuel supply device which more quickly pressurizes the fuel distribution line, thus allowing for a shorter engine starting time than conventional arrangements provide.

The high pressure under which the fuel distribution line remains immediately after shut-down is part of the reason for fuel leakage while the engine is off. Both fuel injection valves and check valves of the high pressure pump prevent sudden decrease in pressure, but the maintained high pressure in the fuel distribution line increases the likelihood that, when the engine is shut off, fuel will leak from the supply side through the leak paths aforenoted.

It is therefore a further object of this invention to provide a method of temporarily and reversibly reducing pressure within the fuel distribution line during engine shut-down.

SUMMARY OF THE INVENTION

This invention is adapted to be embodied in a fuel supply device for an internal combustion-engine, comprising at least one fuel pump, at least one fuel injection valve, and a fuel distribution line connecting the pump to the valve. A pressurizing device is provided for pressurizing the fuel distribution line independently of the fuel pump.

A further feature of this invention is adapted to be embodied in the starting process of an internal combustion engine whereby a fuel distribution line is pressurized independently of, and prior to or simultaneously with, the operation of a high pressure pump, so as to more quickly raise the pressure of the fuel distribution line.

Another feature of this invention is adapted to be embodied in the starting and stopping mechanism and process for an internal combustion engine whereby a fuel distribution line is reversibly depressurized upon engine shut-down.

DETAILED DESCRIPTION OF THE PREFERRED EMBODIMENTS OF THE INVENTION

Figure 1:
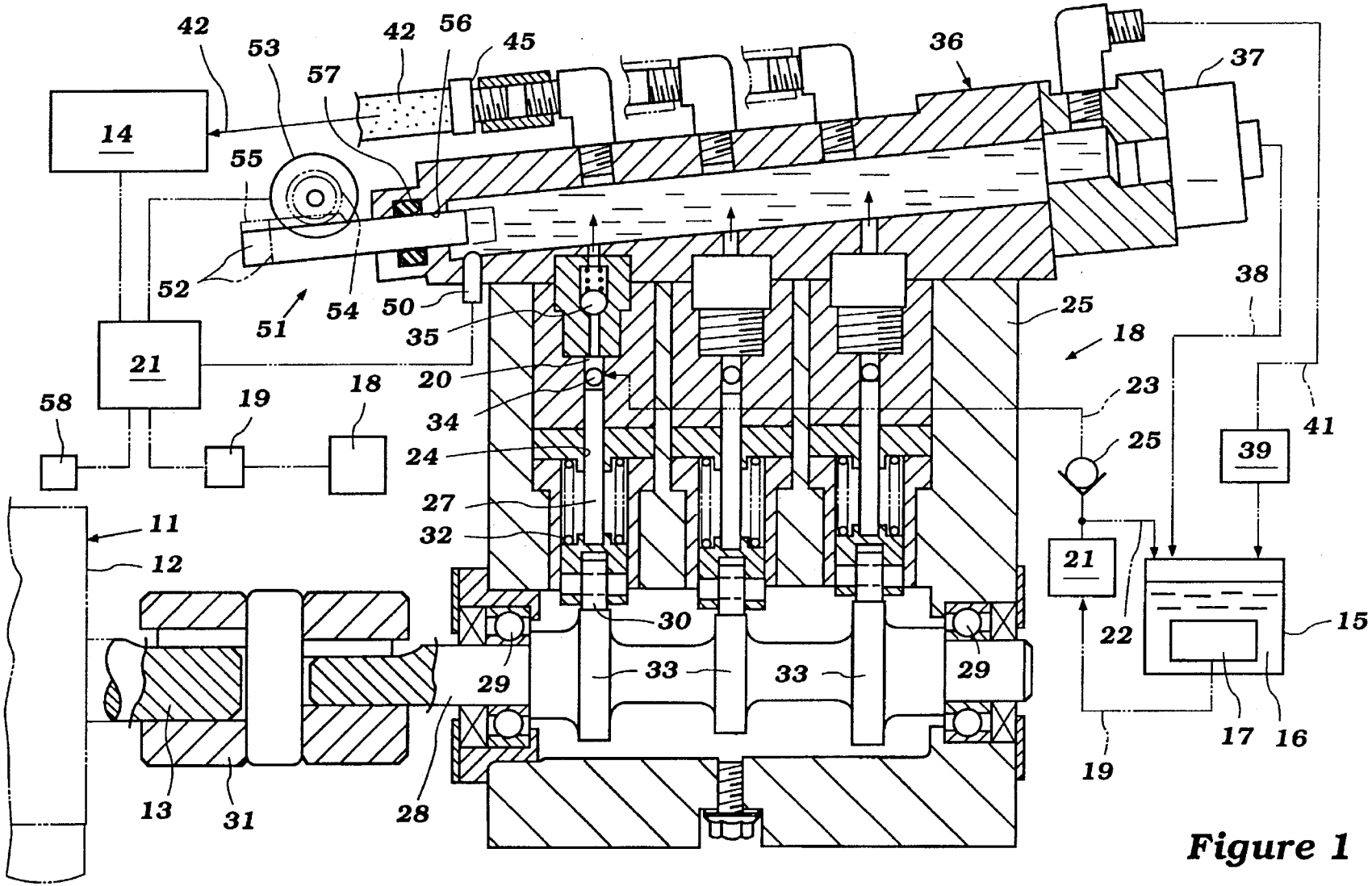
FIG. 1 is cross-sectional view taken through a fuel supply device constructed in accordance with a first embodiment of the invention.

Referring now in detail to the drawings and initially to FIG. 1, a fuel supply device for delivering pressurized fuel from a fuel tank to an internal combustion engine, constructed in accordance with a first embodiment of the invention, is shown in cross-section in FIG. 1. The device is shown in association with a fuel injected internal combustion engine, shown schematically and referred to by the reference numeral 11 in FIG. 1. The embodiment shown is particularly adapted for automotive application. Although the invention is described in conjunction with such an application, it should be readily apparent to those skilled in the art that the invention is capable of use in a wide variety of other applications for fuel injected internal combustion engines and fuel supply devices for such engines.

The engine 11 is of any known type but may, for example, be of the three cylinder inline type operating on a two-stroke crankcase compression principal. Of course, it will be readily apparent to those skilled in the art how the invention can be practiced with any type of engine operating on either a two or four stroke principal and having any number of cylinders or any cylinder configuration.

Since the internal details of the engine 11 can be of any conventional type and since they have no particular relevance to the invention, they have not been illustrated nor will they be described. However, the engine 11 has a crankcase 12 in which a crankshaft 13 is rotatably journaled in a known manner.

The charge forming system for the engine 11 comprises a plurality of fuel injectors, only one of which is depicted and which is indicated schematically at 14. The fuel injectors 14 may, like the engine 11 itself, be of any known type. The invention deals primarily with the fuel supply system for supplying fuel to the injectors 14, particularly during starting and, for that reason, components of the invention that do not relate to the fuel injection system or of the starting arrangement are not illustrated and will not be described.

The system for supplying fuel to the engine and specifically to the fuel injectors 14 includes a fuel tank 15 in which a body of fuel is contained. Fuel is drawn from the fuel tank 15 by means of an in-the-tank type low pressure electrically operated fuel pump 17. The fuel pump 17 is supplied with electrical power from a battery 10 when a main switch 19 is turned on. Turning on of the main switch 19 energizes an electrical control unit (ECU) 21 which controls the timing and duration of the injection of the fuel by the fuel injectors 14, the operation of the electric fuel pump 17 and other components, as will be described.

The low pressure fuel pump 17 supplies fuel to a high pressure fuel pump, indicated generally by the reference numeral 18 through one or more supply lines 16 in which filters 21 are provided. The pressure outputted by the low pressure fuel pump 17 is in the range of 2.5 to 3 kilograms per square centimeter. A low pressure regulator valve (not shown) may be positioned between the filters 21 and the high pressure pump 18 and regulates the low pressure fuel supplied to the high pressure pump 18 by dumping fuel back to the tank 15 through a return line 22.

From the filter 21, there are individual conduits 23 that extend to the individual pump plunger bores 24 formed in a body 25 of the high pressure pump 18. Only one of these pumping chambers will be described and the construction of each pumping chamber and its operation is the same. A delivery check valve 26 is provided in each conduit 23 for precluding reverse flow through the conduit 23 when the served plunger 27 is reciprocated in the plunger bore 24 for compressing the fuel contained in the pumping chamber 20 formed in the bore 24 above the plunger 27. It is preferred that the high pressure fuel pump 18 be constructed in accordance with an embodiment disclosed in the application for a United States patent with Ser. No. 08/262,629, filed by Hasegawa et al on Jun. 20, 1994.

The pump 18 has three plungers 27 which move 120 degrees out of phase with respect to one another when driven by a camshaft 28 journalled in the pump housing 25 by a pair of roller bearings 29. The camshaft 28 is driven by a cogged belt or a set of gears from the crankshaft 15. Alternatively a direct coupling as shown at 31 may be employed. Each plunger 27 is urged by a plunger spring 32 downward, such that a roller/follower 30 journalled by the plunger 27 follows and maintains contact with a respective lobe 33 of the camshaft. When in its lowest position, each plunger 27 falls below the level of a port 34 supplied by the check valve 26, thus allowing fuel from the low pressure fuel pump 17 to enter the pressurizing chamber 20. As the plunger 27 rises, a second check or delivery valve 35 opens so that the pressurized fuel is forced through a passage into a pressure accumulation chamber 36 formed at the upper end of the housing 25, thus pressurizing the pressure accumulation chamber 36. The accumulator chamber 36 communicates with each pumping chamber 20 of the pump 18 and thus further reduces pressure variations.

A chamber regulator 37 is located on the right end of the pressure accumulation chamber 36. The chamber regulator 37 is controlled by the CPU 21 to adjust and maintain the appropriate pressure in the pressure accumulation chamber 36 depending on engine running conditions. It does so by allowing pressure to build to the value set by the control device 21, but beyond that pressure excess fuel is bled off through a chamber return line 38 back to the fuel tank 15. Similarly, a safety relief valve 39 prevents pressure within the pressure accumulation chamber from exceeding a specified maximum value by bleeding excess fuel back to the fuel tank 15 through a return line 41.

Figure 2:
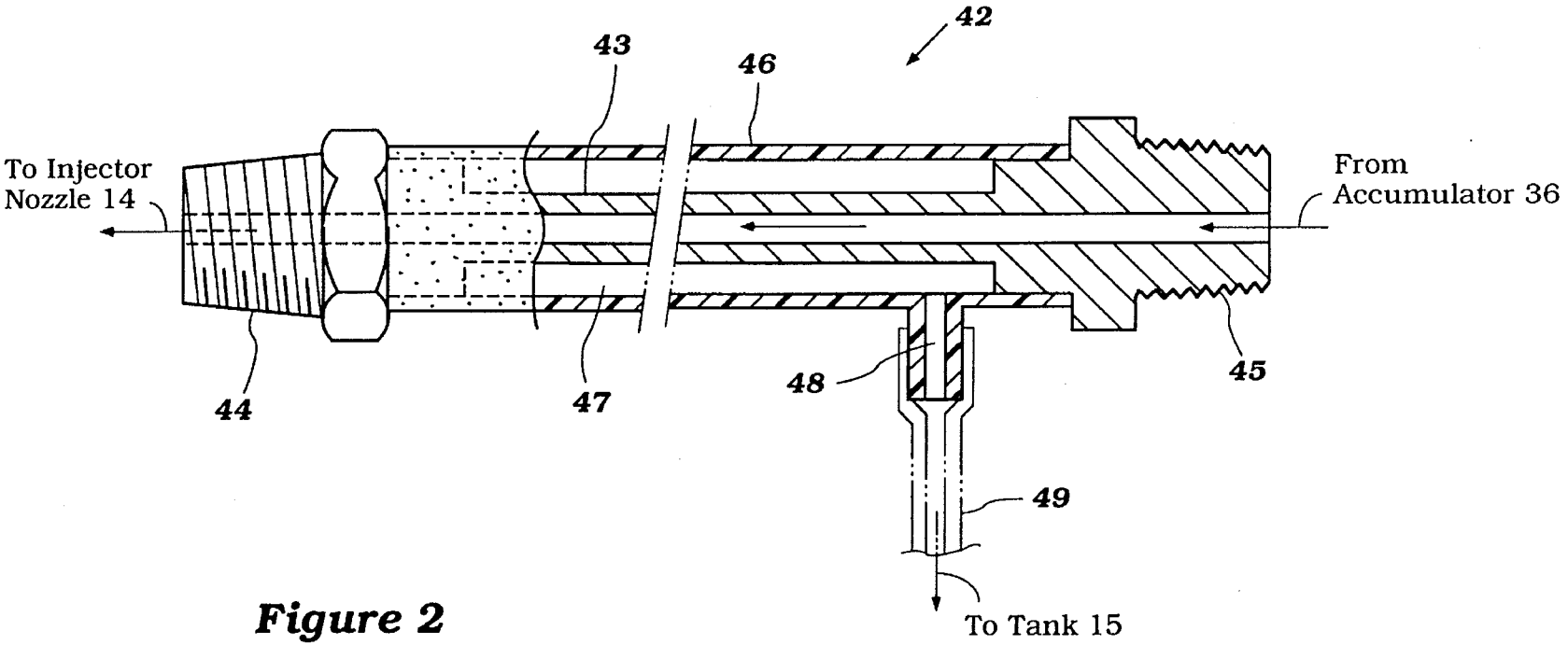
FIG. 2 is cutaway cross-sectional view of a fuel distribution line of the invention.

Individual fuel distribution lines 42 extend from the pressure accumulation chamber 36 to each fuel injection nozzle 14. As shown in FIG. 2, each distribution line 42 includes anti-leak protection and that consists of an inner high pressure metal tube 43 connected at its opposite ends to fittings 44 and 45 for connection to the injection nozzle 14 and accumulator 36, respectively. A sheath tube 46 of rubber or teflon is sealed at its ends to the fittings 44 and 45 to define a sealed space 47 around the metal tube 43. The sealed space 47 collects any fuel leaked, for example, by reason of shock damage to the high pressure metal tube 43. Such leaked fuel is led back to the fuel tank 15 though a return fitting 48 and tube 49.

The system as thus far described, except for the antileak tube 42 may be considered to be conventional. As noted previously, these conventional systems provide delayed starting under conditions when the engine 11 has been shut down for long periods of time. This long shut down permits the leak down of pressure from the accumulator chamber 36 through internal leakages in either the nozzles 14 and/or high pressure pump 18. This problem with the prior art type of construction is avoided with the present invention through the use of a pressurizing device 51 which pressurizes the pressure accumulation chamber 36 independently of, and preferably prior to or simultaneous with, the pressurization by the high pressure fuel pump 18.

Referring now again to FIG. 1, a first embodiment of the invention is shown. The pressurizing device 51 comprises a movable piston 52, a pressurizing reversible electric motor 53 operated the CPU 21, and, preferably, a pressure sensor 50 which provides a pressure signal to the CPU 21. The CPU 21 may be a programmable microchip. The pressurizing motor 53 output shaft drives a pinion gear 54 which interengages a rack 55 formed on the surface of the piston 52, allowing the motor 53 to drive the piston 52. The piston 52 is supported in a bore 56 of the housing of the accumulator 36 and extends into its accumulator chamber. An O-ring seal 57 prevents fuel leakage through the bore 56.

The system also incorporates a starter switch 58 which operates a conventional electric starter shown schematically at 59 for starting the engine 11. The starter 59 and specifically its connection to the starter switch 58 is controlled by the CPU 21 in accordance with a feature of the invention.

When the main switch 19 is turned on, the CPU 21 causes the pressurizing motor 53 to rotate, driving the piston 52 into the pressure accumulation chamber 36, which chamber is preferably of circular transverse cross section and tilted downward on the end attached to the pressurizing device 51. Alternatively, the pressurizing motor 53 may be started simultaneously with the starter switch 58, which then causes the cranking by the starter motor 59 to begin simultaneously or possibly after a predetermined time delay. The first check valves 26 prevent significant fuel leakage from the upstream side of the pressure accumulation chamber 36, and the closed fuel injection valves 14 prevent significant fuel leakage on the downstream side. Thus, as the piston 52 displaces volume, the piston 52 pressurizes the fuel in the pressure accumulation chamber 36 and the rest of the fuel distribution line 42.

The CPU 21 preferably stops the pressurizing motor 53 from driving the piston 52 once the pressure sensor 50 senses a sufficient pressure in the pressure accumulation chamber 36. It is also possible for the CPU 21 to simply operate the pressurizing motor 53 for a pre-determined period of time, or until a predetermined length of the piston 52 intrudes into the pressure accumulation chamber 36.

In accordance with one operational embodiment of the invention, once the motor 53 has been deenergized by the CPU 21, the piston 52 will be retained in its extended position during the running of the engine. Because of the fact that the accumulator chamber 36 and supply lines 42 have been pressurized in addition to the pressurization caused by the operation of the high pressure pump 18, starting times will be significantly improved even if there has been a substantial leak down of fuel pressure in the system during long periods of shut down.

When the main switch 19 is turned off, both the low pressure fuel pump 17 and the high pressure fuel pump 18 cease operating. However, in the preferred arrangement of the first embodiment, shown in FIG. 1, the piston 52 of the pressurizing device 51 is retracted from the pressure accumulation chamber 36 when the main switch 19 is turned off. Under this condition the CPU 21 causes the reverse rotation of the pressurizing motor 53. This action draws fuel through the first check valves 26 into the pressure accumulation chamber 36, allowing the later pressurization of a greater volume of fuel when main switch 19 is again turned on and the piston 52 is extended into the pressure accumulation chamber 36. The retraction also tends to depressurize the fuel distribution line 42 and accumulator 36, reducing the likelihood of fuel leakage.

In an alternative arrangement of the first embodiment, as described above, the piston 52 is not held in place after injected into the pressure accumulation chamber 36. Rather, the piston 52 will be pushed back to its starting position by the increasing pressure created by the high pressure fuel pump 18. This increasing pressure is a result of the fact that the high pressure fuel pump 18 is capable of delivering more fuel to the accumulator chamber 36 than is ejected from the fuel distribution lines 42 through the fuel injection nozzles 14. Once the piston 52 is pushed back to its starting position, the continued excess fuel delivered to the pressure accumulation chamber 36 is bled back to the fuel tank 15 through the chamber regulator 37.

Figure 3:
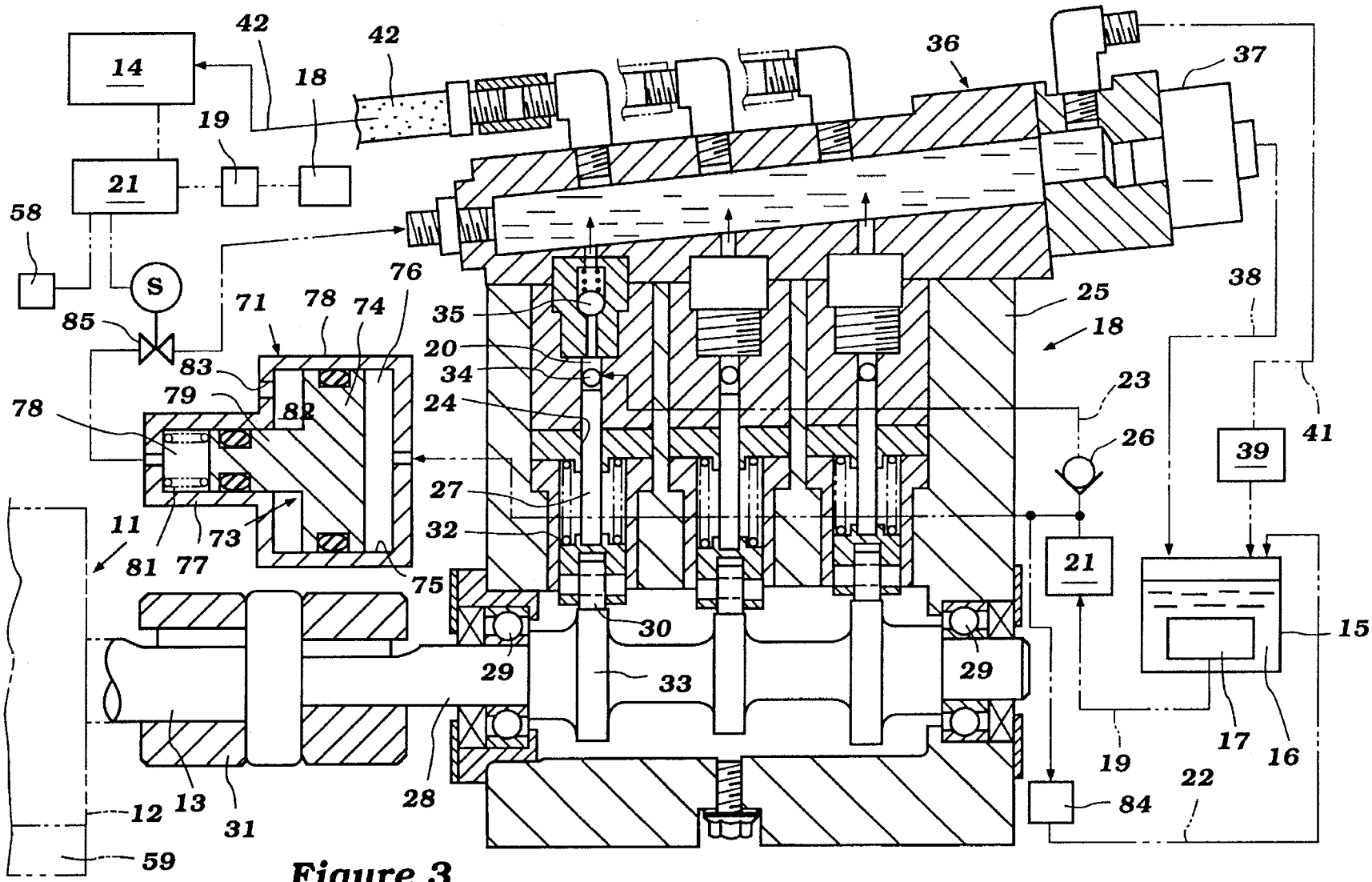
FIG. 3 is cross-sectional view taken through a fuel supply device constructed in accordance with a second embodiment of the invention.

Referring now to FIG. 3, a second embodiment of the present invention is shown. Since the embodiment is the same as that previously described, components which are the same are identified by the same reference numerals. The prime difference is in the arrangement for and operation of the device for pressuring in the accumulator 36 and delivery lines 42. The pressurizing device, indicated generally by the reference numeral 71, includes a composite cylinder 72 fitted with a composite piston 73. On a receiving side of the composite cylinder 73 is a large diameter cylinder 75 forming a receiving chamber 76 with large diameter portion 74 of the composite piston 73. On the supplying side of the composite cylinder 72 has a small diameter cylinder bore 77 defining a supplying chamber 78, defined by the small cylinder bore 77 and a small diameter portion 79 of the composite piston 73. A retraction spring 81 in the bore 77 exerts a force on the composite piston 73 urging it toward the receiving side of the composite cylinder 72.

A chamber 82 is formed on the side of the large diameter piston portion 77 opposite the receiving chamber 76. This chamber 82 is vented to the atmosphere through a vent port 83.

When the main switch 19 is turned on, the low pressure fuel pump 17 delivers fuel from the fuel tank 15 to the high pressure fuel pump 18, as described above, but also to the receiving chamber 76 of the pressurizing device 71.

The pressure of the fuel supplied to the receiving chamber 76 is that set by the aforenoted pressure regulator which appears in FIG. 3 schematically and is identified by the reference numeral 84. The composite piston 73 shifts toward the supplying side of the composite cylinder 72, causing an increase in pressure from the receiving chamber 76 to the supplying chamber 78, corresponding to the ratio of the transverse cross-section of the large piston area 74 to that of the small piston area 79. The pressurized fuel is supplied to the pressure accumulation chamber 36 through a pressurizing valve 85, which is connected to the CPU 21 and is opened when the main switch 19 is turned on. When the starter switch 58 is turned on, the pressurizing valve 85 closes, maintaining the increased pressure in the pressure accumulation chamber 36, while at the same time cranking begins and the high pressure fuel pump 18 is driven as described below.

The pressurizing valve 85 remains closed until the main switch 19 is turned off, at which time the pressurizing valve 85 preferably opens and the low pressure fuel pump 17 shuts down. The force of the retraction spring 81 is sufficient to shift the composite piston 73 toward the receiving end of the composite cylinder 76, i.e., back to the piston's 73 starting position. As in the arrangement of the first embodiment in which the piston 72 retracts after engine 11 shutdown, this depressurizes the pressure accumulation chamber 36 and leaving the pressurizing device 71 ready to pressurize the pressure accumulation chamber 36 when the switch 19 is next turned on.

Note that other methods of supplying pressurized fuel to the pressure accumulation chamber 36 may constitute equally acceptable substitutes for the composite cylinder 71 structure of the second embodiment shown. Mechanisms similar to the alternative arrangements mentioned for the first embodiment may achieve the objects of this invention equally well. For example, the retraction spring 81 might be chosen such that the composite piston 73 may slowly be forced back to its starting position while the high pressure fuel pump 18 operates with the pressurizing valve 85 kept open.

Once the high pressure fuel pump 18 has begun operating the pressure accumulation chamber 36 quickly becomes pressurized, as the pressurizing device 71 has already partially pressurized it.

Regardless of which of the two embodiments is employed, the pressure in the fuel distribution line 42, which includes the pressure accumulation chamber 36 builds to the desired level (about 30 $kg/cm^2$) quicker with the prior pressurization of the pressurizing device 71 than it would without the device.

It should be readily apparent that the described embodiments of the invention provide a very effective fuel supply device, wherein the pressure of the fuel distribution line is quickly raised to the required level because a device independent of the starter motor or engine drive prepressurizes the line. Of course, the foregoing description is that of preferred embodiments of the invention, and various changes and modifications may be made without departing from the spirit and scope of the invention, as defined by the appended claims.

We claim:

1. A fuel supply device, comprising at least one fuel pump connected to a fuel source, at least one fuel injection valve, a fuel distribution line connecting said fuel pump with said fuel injection valve, a pressurizing device for pressurizing said fuel distribution line independently of said fuel pump, and a safety valve to relieve any excess pressure from said pressurizing device, the safety valve connected to said fuel source by a return line.

2. The fuel supply device of claim 1, wherein the fuel distribution line includes a pressure accumulation chamber.

3. The fuel supply device of claim 2, wherein the fuel pump includes at least two positive displacement pumping devices, each of said pumping devices capable of delivering pressurized fuel to the pressure accumulation chamber.

4. The fuel supply device of claim 2, wherein the pressurizing device displaces a volume of fuel in the pressure accumulation chamber.

5. The fuel supply device of claim 4, wherein the pressurizing device comprises a piston, driven by a pressurizing motor into the pressure accumulation chamber, thereby displacing said volume of fuel.

6. The fuel supply device of claim 5, wherein said pressurizing motor drives said piston into the pressure accumulation chamber for a pre-determined length of time.

7. The fuel supply device of claim 5, wherein said pressurizing motor drives said piston a pre-determined distance into the pressure accumulation chamber.

8. The fuel supply device of claim 5, wherein said pressurizing motor drives said piston until the pressure accumulation chamber reaches a pre-determined pressure.

9. The fuel supply device of claim 2, further comprising a fuel tank for storing fuel and an internal combustion engine, a starter for starting said engine, a stopping device for stopping said engine, and a circuit for operating said starter and stopping device, said engine driving the fuel pump.

10. The fuel supply device of claim 9, wherein the pressurizing device pressurizes the pressure accumulation chamber before or while the engine starts.

11. The fuel supply device of claim 5, further comprising a fuel tank for storing fuel and an internal combustion engine, a starter for starting said engine, a stopping device for stopping said engine, and a circuit for operating said starter and stopping device, said engine driving the fuel pump.

12. The fuel supply device of claim 11, wherein the piston partially retracts from the pressure accumulation chamber after the engine is started.

13. The fuel supply device of claim 11, wherein said pumping devices include check valves allowing fuel to flow in one direction only, and the piston withdraws from the pressure accumulation chamber when the engine is stopped.

14. The fuel supply device of claim 3, wherein the pressurizing device delivers pressurized fuel to the pressure accumulation chamber.

15. The fuel supply device of claim 14 wherein the pressurizing device comprises a large cylinder and a small cylinder, said large cylinder and small cylinder connected by a composite piston.

16. The fuel supply device of claim 15, further comprising a low pressure fuel pump and a high pressure fuel pump, said low pressure fuel pump delivering fuel from a fuel tank to said high pressure fuel pump and to the large cylinder of the pressurizing device.

17. The fuel supply device of claim 15, wherein the small cylinder includes a spring exerting a force on the composite piston.

18. A method of operating a fuel supply device, having at least one fuel pump connected to a fuel source, at least one fuel injection valve, and a fuel distribution line connecting said fuel pump with said fuel injection valve, said method including a step of pre-pressurizing the fuel distribution line independently of the fuel pump, in response no a signal that an internal combustion engine is to be started, and a step of relieving any excess pressure generated by said pre-pressurizing step and returning any excess fuel to said fuel source.

19. The method of claim 18, further including the later or simultaneous steps of delivering pressurized fuel from said fuel distribution line to said fuel injection valve, and starting an internal combustion engine connected to said fuel injection valve.

20. The method of claim 19, further including the later step of further pressurizing said fuel distribution line by delivery of fuel from said fuel pump to said fuel distribution line, driven by said internal combustion engine.

21. The method of claim 20, further including the later or simultaneous step of reversing said first step of pressurizing said fuel distribution line independently of said fuel pump, whereby the internal combustion engine may again be pre-pressurized.

22. The method of claim 18, wherein excess fuel is returned to the fuel source when a pressure level within the fuel distribution line exceeds a maximum level.

23. A fuel supply device, comprising a low pressure fuel pump and a high pressure fuel pump, at least one fuel injection valve, a fuel distribution line connecting said high pressure fuel pump with said fuel injection valve, and a pressurizing device for pressurizing said fuel distribution line independently of said high pressure fuel pump.

24. A method of operating a fuel supply device having a high pressure fuel pump, a low pressure fuel pump, at least one fuel injection valve, and a fuel distribution line connecting said high pressure fuel pump with said fuel injection valve, said method including a first step of pressurizing said fuel distribution line independently of said high and low pressure fuel pumps, in response to a signal that an internal combustion engine is to be started.

* * * * *

UNITED STATES PATENT AND TRADEMARK OFFICE

CERTIFICATE OF CORRECTION

PATENT NO. : 5,546,912
DATED : August 20, 1996
INVENTOR(S) : Yamada et al.

It is certified that error appears in the above-identified patent and that said Letters Patent is hereby corrected as shown below:

Column 8,
Line 14, please change “response no a” to -- response to a --.

Signed and Sealed this

Third Day of December, 2002

JAMES E. ROGAN
*Director of the United States Patent and Trademark Office*